US007922383B2

(12) United States Patent
Garcia et al.

(10) Patent No.: US 7,922,383 B2
(45) Date of Patent: Apr. 12, 2011

(54) MODULAR CABINET FOR STORING AND DRIVING STIRRER CANS

(75) Inventors: Thierry Leon Claude Garcia, Rambouillet (FR); Michel Denis Lesimple, Coulomb (FR); Jacky Gaulupeau, Boullay-Thierry (FR)

(73) Assignee: Fillon Investissement, Faverolles (FR)

( * ) Notice: Subject to any disclaimer, the term of this patent is extended or adjusted under 35 U.S.C. 154(b) by 1055 days.

(21) Appl. No.: 10/561,432

(22) PCT Filed: Jun. 16, 2004

(86) PCT No.: PCT/FR2004/001490

§ 371 (c)(1),
(2), (4) Date: Mar. 22, 2007

(87) PCT Pub. No.: WO2004/112949

PCT Pub. Date: Dec. 29, 2004

(65) Prior Publication Data

US 2007/0206437 A1 Sep. 6, 2007

(30) Foreign Application Priority Data

Jun. 19, 2003 (EP) ..... 03291492

(51) Int. Cl.
*B01F 7/16* (2006.01)
*B44D 3/08* (2006.01)

(52) U.S. Cl. ..... 366/198; 366/605

(58) Field of Classification Search ..... 366/197–198, 366/242–251, 605
See application file for complete search history.

(56) References Cited

U.S. PATENT DOCUMENTS

| | | | | | |
|---|---|---|---|---|---|
| 2,802,649 | A | * | 8/1957 | Stockton | 366/197 |
| 2,965,363 | A | * | 12/1960 | Worden | 366/197 |
| 3,118,653 | A | * | 1/1964 | Dedoes | 366/200 |
| 4,225,248 | A | * | 9/1980 | Para | 366/251 |
| 5,096,071 | A | * | 3/1992 | Neri | 211/85.18 |
| 5,160,198 | A | * | 11/1992 | Fillon | 366/198 |
| 5,169,232 | A | * | 12/1992 | Fillon et al. | 366/249 |
| 5,310,258 | A | * | 5/1994 | Godat et al. | 366/251 |
| 5,697,703 | A | * | 12/1997 | Lucchetti | 366/198 |
| 5,800,057 | A | * | 9/1998 | Lesimple | 366/198 |
| 5,904,420 | A | * | 5/1999 | Dedoes | 366/198 |
| 5,947,598 | A | * | 9/1999 | Dedoes | 366/198 |
| 6,033,106 | A | * | 3/2000 | Lesimple et al. | 366/198 |
| 7,160,022 | B2 | * | 1/2007 | Krzywdziak et al. | 366/198 |
| RE39,732 | E | * | 7/2007 | Lesimple | 366/198 |
| 2005/0041524 | A1 | * | 2/2005 | Krzywdziak et al. | 366/198 |
| 2007/0206437 | A1 | * | 9/2007 | Garcia et al. | 366/198 |

FOREIGN PATENT DOCUMENTS

| | | | | |
|---|---|---|---|---|
| EP | 65498 | A2 | * | 11/1982 |
| EP | 125213 | A2 | * | 11/1984 |
| EP | 127589 | A2 | * | 12/1984 |
| EP | 143145 | A2 | * | 6/1985 |

(Continued)

*Primary Examiner* — Charles E Cooley
(74) *Attorney, Agent, or Firm* — Jacobson Holman PLLC

(57) ABSTRACT

There is described a modular cabinet for storing and driving stirrer cans containing liquids, the modular cabinet comprising a bottom stand on which at least one cabinet module is mounted, and a motion transmission system constituted by driver transmission elements and by driven transmission elements, each cabinet module being made up of two upright elements and a mechanical shelf for supporting and driving stirrer cans. The driver transmission elements of the motion transmission system are disposed outside said mechanical shelf and are independent thereof, and the mechanical shelf contains only the driven transmission elements.

21 Claims, 10 Drawing Sheets

FOREIGN PATENT DOCUMENTS

| | | | | |
|---|---|---|---|---|
| EP | 1776997 | A2 | * | 4/2007 |
| FR | 2521493 | | | 8/1983 |
| FR | 2521493 | A | * | 8/1983 |
| FR | 2562874 | A2 | * | 10/1985 |
| FR | 2649911 | | | 1/1991 |
| FR | 2785953 | A | * | 5/2000 |
| GB | 2203059 | A | * | 10/1988 |
| WO | WO 03/045707 | A1 | | 6/2003 |

* cited by examiner

MODULAR CABINET FOR STORING AND DRIVING STIRRER CANS

This is a 371 of PCT/FR04/001490 filed Jun. 16, 2004.

The invention relates to cabinets for stirrer cans that are used for storing liquids, such as paint or the like, and for stirring them continuously. In particular, the invention relates to modular cabinets.

For about forty years, numerous cabinets have been available on the market for storing and/or stirring cans of paint preferably arranged as small containers of the cylindrical metal or plastics can type having a volume lying in the range 0.5 liters (L) to 5 L in application of standards that are known around the world. In general, such machines or cabinets for stirring liquid paint can be subdivided into two major families:

so-called "compact" machines (or cabinets) in which the uprights are of one-piece structure; and so-called "modular" machines (or cabinets) in which the uprights are fractioned in structure.

The first family of machines constitutes more than two-thirds of the applications of the market. It consists in storing and/or stirring a complete line of cans of paint having 20 to 120 basic tints and forming the color palette of a paint manufacturer. Stirrer machine models come in various widths of 1 meter (m), 1.5 m, or 2 m, with four to seven shelves depending on the configuration of the paint line, and preferably six shelves for the most common configurations. Machines of this type are characterized by one-piece uprights at opposite ends of the shelves.

About twenty years ago, a new concept for a modular stirrer machine was launched on the market to satisfy the requirements of paint manufacturers by providing greater flexibility in terms of paint lines of variable configuration. Machines of this type are characterized by uprights that are fractioned, corresponding to as many individual stirrer modules as the desired number of shelves. Thus, the machine can be built up on demand from a single shelf to a stack of seven (or more) shelves depending on requirements.

The present invention relates more particularly to modular cabinets. Cabinets of this type generally comprise modules with can support shelves disposed one above another and connected at their ends to uprights. The stack of individual modules constitutes the structure of the machine. The columns as formed in this way can also be juxtaposed side by side in alignment or perpendicularly in order to increase machine configurations starting from a model of single width. The set of columns is driven by a single motor with drive continuity being transferred in the stands by pulley and belt systems.

A central motor is mounted on a motor stand for connection to a motion transmission system to transmit rotary motion to stirrer blades inside the cans so as to ensure that the entire line of paint cans is stirred fully and simultaneously, with the blades possibly being generally helical in shape. The motion transmission system may be constituted by one or more drive shafts distributed in the uprights of the cabinets together with drive chains or belts that are optionally accessible and that are to be found in the supporting shelves, which is why such shelves are also referred to as "mechanical shelves". Within these cabinets there is thus a mechanical transmission system serving to ensure that the liquids in the cans stored on the shelves are stirred. The drive system is generally an indirect drive system and is made up of a plurality of speed reduction stages for reducing the speed of rotation of a single motor of the asynchronous motor type operating at a speed in the range 750 revolutions per minute (rpm) to 1800 rpm, and at 50 hertz (Hz) or 60 Hz, to the stirring speed required for a multitude of blade type stirrers secured to stirrer lids of cans that need to revolve at 70 rpm to 120 rpm. Thus, between the initial motor and the final driven receivers there is an intermediate transmission system that provides continuity of motion.

For reasons of stability, the modules of the cabinet are generally made of a metal structure with the motion transmission system being arranged therein in the form of chain or belt pulleys associated with a line of drive shafts or wormscrews associated with lines of drive belts. Paint cans are placed on the shelves, but they could equally well be suspended close to the shelves. All kinds of combination can be devised between the type of transmission and the position of a can.

In general, two known systems are available on the market for driving stirrer blades inside the cans: a system with blade-type driver heads that co-operate with fingers mounted on a shaft that passes through the lid of a can and that carries the stirrer blade inside the can, or another system with gears or wheels mounted on the shaft of the stirrer blade and driven respectively by a chain or a belt, or else by a wormscrew located in each shelf.

In the configuration that is most usually encountered, individual blade-type drive heads are provided beneath the shelves, thereby forming as many individual stirring stations as are required. The blade-type drive heads of each shelf co-operate with complementary elements mounted on the stirrer lids of the cans via the projecting fingers of a fork that are used to drive a shaft passing through the stirrer lid and supporting a stirrer blade inside the can. The stirrer stations formed in this way are positioned on the axes of the drive heads. That arrangement in alignment on coplanar axes ensures that mechanical motion is transmitted from stage to stage.

In another type of drive, a one-piece drive line is provided that is accessible from the front faces of chain or belt type shelves that form stirrer zones. The drive lines in each of the shelves co-operate with complementary elements mounted on the stirrer lids of the cans via the sets of teeth on gears or wheels serving to drive a shaft passing through each stirrer lid and supporting a stirrer blade inside a can. The stirrer zones as formed in this way are disposed in such a manner as to be perpendicularly offset from the drive line. That arrangement that is not aligned on non-coplanar axes also serves to transmit mechanical motion from stage to stage.

Users desire stirrer machines to be made available that are ever less expensive and ever more versatile. Consequently, stirrer cabinets or machines must be suitable for being assembled quickly and without using tools. As a result, technical configurations must tend to reduce the number of assembly operations needed for each individual subassembly. Thus, machines must contain as many preassembled elements as possible so as to ensure that the user is not subjected to an assembly time that is too long. In addition, the various modules of a stirrer cabinet must be as simple as possible in order to reduce manufacturing cost, in particular by limiting the variety of subassemblies or by reducing the diversity of existing models for standardization purposes.

The stirrer cabinet must also provide modularity and a structure that is versatile and capable of accepting a variety of peripheral options such as rear storage shelves, covers for a heated space, or even the absence of any mechanical stirrer elements on some of the shelves. Such a modern stirrer cabinet must also satisfy other requirements such as:

keeping the number of assembly parts down to a strict minimum so as to reduce the amount of handling;

reducing the size of the preassembled subassemblies so that they can be packaged compactly;

simplifying the design of the sheetmetal-work so as to implement a low-cost version of the machine;

for maintenance purposes (e.g. changing a motor or a belt), the transmission members must be accessible quickly without requiring the structure of the machine to be dismantled, while nevertheless being effective in transmitting torque; and furthermore, once the machine has been fully assembled, a mechanical shelf must be capable of remaining removable, either so that it can be replaced if it becomes worn, or so that it can be installed subsequently if no provision was made for it from the beginning.

A modular cabinet has already been disclosed in document FR 2 649 911. Nevertheless, the motion transmission system is very complex, and in particular the driver pulleys and the driven pulleys form integral parts of the mechanical shelf, which makes the assembly more complicated to construct and dismantle. Furthermore, because the shaft line forms a part of the mechanical shelves, a full range of stirrer machines possesses different spacing values for different mechanical shelves, which does not make it possible to reduce the variety of parts that need to be made out of sheet metal, nor does it enable the parts to be simplified for an entire range of stirrer machines. Furthermore, the cabinet modules are single units that are assembled in the factory. Packaging is therefore bulky. Once modules have been received by the user, they need to be assembled to one another by simple plastics spacers in order to facilitate positioning, prior to securing them by screw-fastening. That kind of assembly is lengthy for the user and does not enable a structure to be obtained that is sufficiently rigid, so it is necessary to place a stiffening strip on the rear portion of the assembly in order to consolidate the unstable hinged configuration.

A modular cabinet is also known from document FR 2 783 177. However, in that case also, the line of drive shafts that rotates a closed-loop belt inside a mechanical shelf drive unit, is to be found within the mechanical shelf. In addition, the line of shafts must be installed stage by stage by the user during assembly of the modular stirrer machine. The uprights of each module are constituted to receive numerous mutually-engaged tubes, making assembly lengthy and tedious. That tubular structure does not provide a machine that is completely rigid and it continues to be somewhat unstable laterally.

The invention thus seeks to provide versatile storage and/or stirring configurations for a paint line, in a manner that is modular and flexible, and that is as inexpensive as possible. Another object of the invention is to make it possible for the line of shafts to be handled in limited manner and without tools during assembly, and to simplify the design of a mechanical shelf so as to reduce manufacturing cost.

These objects are achieved by a modular cabinet for storing and driving stirrer cans comprising a bottom stand on which at least one cabinet module is mounted, and a motion transmission system constituted by driver transmission elements and driven transmission elements, each cabinet module being made up of two upright elements and a mechanical shelf for supporting and driving stirrer cans. According to the invention, the driver transmission elements of the motion transmission system are disposed outside said mechanical shelf and are independent thereof, and the mechanical shelf contains only driven transmission elements.

Because the drive transmission elements are concentrated in a part that is outside the mechanical shelves and because the driven transmission elements are concentrated in the mechanical shelves, great flexibility is obtained in configuring variant paint lines. The drive system can thus be varied freely as a function of requirements whether or not there is any need to stir paints without that interfering with the architecture of the machine as an assembly of nodes.

The overall size of the preassembled subassemblies is also reduced so that they can be packaged compactly, in particular by separating the modular uprights from the structure of a stage. The cabinet modules are then more compact because of the separated component elements. In the invention, only three preassembled subassemblies are provided per cabinet module (each subassembly comprising two identical upright elements and a mechanical shelf).

In an advantageous embodiment of the invention, all of the connection functions between the upright elements and the mechanical shelf are concentrated around a central node which ensures that the assembly is completely rigid. Preferably, the upright elements and the central connection node are assembled together by mutual engagement and held together by snap-fastening. The central node may also be made as a plurality of distinct portions or as two symmetrical hermaphrodite portions. Advantageously, it is made of plastics material and constitutes the seat of fastenings for numerous accessory elements such as a work surface, an electronic control unit, coverings, rear storage shelves, etc.

Since the central node concentrates all of the connection functions together, it can as a result integrate the line of drive shafts. All of the connection functions are thus advantageously grouped about architecture based on an assembly of nodes.

In a preferred embodiment, the two upright elements and the mechanical shelf of each cabinet module are mounted by portions fitting one within another over a distance that is sufficient to ensure that the assembly is rigid. The rigidity of the structure is thus ensured solely by mutual engagement, thereby avoiding the need to put conventional rear cross-braces into place that interfere with positioning a rear storage shelf.

In another aspect of the invention, the driver transmission elements are constituted by a fractioned line of drive shafts. One of the two upright elements of each module includes a portion of the fractioned drive shafts, and the portion of the fractioned drive shafts is secured to the upright elements in such a manner as to be free to move in rotation and in translation. Thus, this portion of the fractioned drive shafts can also be secured to the upright elements in releasable manner. The line of fractioned shafts is thus independent of a mechanical shelf.

Because the drive shaft line is fractioned, a modular upright is self-contained, combining the capability of being installed with a minimum amount of handling, a reduction in volume when packaging a preassembled mechanical shelf, and enabling rapid decoupling, e.g. for maintenance operations and belt-changing operations. Since each portion of the fractioned drive shaft line is secured individually to the upright element so as to be free to move in rotation and in translation, there is no need to install the shaft line when assembling the cabinet. Assembly operations can thus be performed "blind". In addition, since the portion of the fractioned drive shaft is free to move in rotation and in translation, flexibility is conserved in aligning the fractioned shafts so as to ensure that drive is maintained regardless of geometrical defects (e.g. due to how the machine is positioned).

In a particular aspect of the invention, the drive shaft presents a section of constant non-circular curvilinear or polygonal shape. Preferably, the drive shaft has a non-circular curvilinear shape such as a profile of the Torx® type, by way of example. It can be made by extrusion. The drive shaft may also possess a hollow core and be made of aluminum. The specific shape of the shaft and the fact that it is made of aluminum, which is much lighter than shafts made of steel, serves to improve performance in terms of toque transmission.

Endpieces are preferably secured to both ends of a drive shaft and are of geometrical shapes that match those of the shaft. These endpieces provide connections with the drive gears for the drive blades of each central connection node. Advantageously, mutual engagement is achieved with sufficient clearance to make angular self-adjustment simple and fast for the line of shafts whenever two ends of the integrated upright and fractioned shaft assembly are mounted on an already-positioned lower shelf, or an upper shelf is positioned on an already-positioned upright. This can provide a connection that is flexible for accommodating alignment defects in a modular structure. The mechanical energy needed on starting and during angular acceleration is optimized by reducing the moments of inertia of the line of shafts. Preferably, the endpieces are made of a plastics material that is sufficiently elastic to accommodate shocks on starting and sufficiently hard to transmit torque. Also advantageously, the endpieces of the shaft are fitted and held in place by U-shaped clips. The number of parts in the shaft line is thus extremely small and it is of greater accessibility during any disassembly for a belt changing operation.

Advantageously, the bottom stand includes a motor for driving the drive transmission elements. Preferably, the motor is separable without disassembling the bottom stand or the structure of the machine. The main motor that is removable without difficulty can thus easily be interchanged for maintenance purposes.

Preferably, the mechanical shelf is removable without removing the stirrer modules. In an advantageous embodiment, the cabinet includes at least one cabinet module with support shelves for storing cans that do not have any motion transmission elements.

In another aspect, the invention is provided by a modular cabinet for storing and driving stirrer cans containing liquids, the modular cabinet comprising a bottom stand having at least one cabinet module mounted thereon, and a motion transmission system constituted by driver transmission elements and driven transmission elements, each modular cabinet being made up of two upright elements and a mechanical shelf for supporting and driving stirrer cans, the cabinet being characterized in that all of the driver and driven transmission elements are disposed inside said mechanical shelf, and in that the mechanical shelf includes at least one motor and gearbox unit for driving the motion transmission system.

In another advantageous form, the mechanical shelf includes individual motor and gearbox units mounted directly on the drive stations for transmitting the rotary motion of the unit to the stirrer blades inside the cans. This makes it possible to obtain a structure for the cabinet that is even more compact.

In another aspect, the invention provides a modular cabinet for storing and driving stirrer cans containing liquids, the modular cabinet comprising a bottom stand on which at least one modular cabinet is mounted, and a motion transmission system constituted by driver transmission elements and driven transmission elements, each cabinet module being made up of two upright elements and a mechanical shelf for supporting and driving stirrer cans, the cabinet being characterized in that the driver transmission elements are constituted by a line of fractioned drive shafts and one of the two upright elements of each module includes a portion of the fractioned drive shaft, and in that said portion of the fractioned drive shaft is secured to the upright elements in such a manner as to be free to move in rotation and in translation. Preferably, under such circumstances, the portion of the fractioned drive shaft is secured to the upright element in removable manner.

Other characteristics and advantages of the invention appear on reading the following detailed description made with reference to the accompanying drawings.

BRIEF DESCRIPTION OF THE DRAWINGS

FIG. 1 is an overall view of a modular cabinet in a preferred embodiment of the invention. The modular cabinet 1 comprises a bottom stand 2 on which one or more modular cabinets are mounted. Each modular cabinet is made up of two upright elements 3 and a mechanical shelf 4 for supporting and driving stirrer cans. In order to simplify the diagram, the stirrer cans are not shown in FIG. 1. FIG. 2 shows two modular cabinets of the same type in FIG. 1 placed side by side.

FIG. 3*a* shows the bottom stand 2 of the modular cabinet in an embodiment of the invention. The bottom stand 2 includes a motor 5 for driving motion transmission elements. In order to make maintenance easier, the motor can be removed without dismantling either the bottom stand or the structure of the machine. The bottom stand 2 itself is constituted by two upright elements 3 and a mechanical shelf 4. Nevertheless, in spite of its standard configuration, the mechanical shelf 4 of the bottom stand 2 does not have an element for driving stirrer cans and is not used for supporting stirrer cans. The upright elements 3 are secured to bottom leg elements 6. FIG. 3*b* shows the bottom stand assembly 2 together with the motor 5.

Nevertheless, and advantageously, the driver and driven transmission elements as a whole could also be disposed inside the mechanical shelf 4. Under such circumstances, the mechanical shelf 4 comprises at least one motor and step-down gearbox unit for driving the motion transmission system. In another advantageous embodiment, the mechanical shelf may include individual motor and gearbox units mounted directly on drive stations transmitting the rotary motion of the motor unit to stirrer blades inside the cans.

Figure 4C:
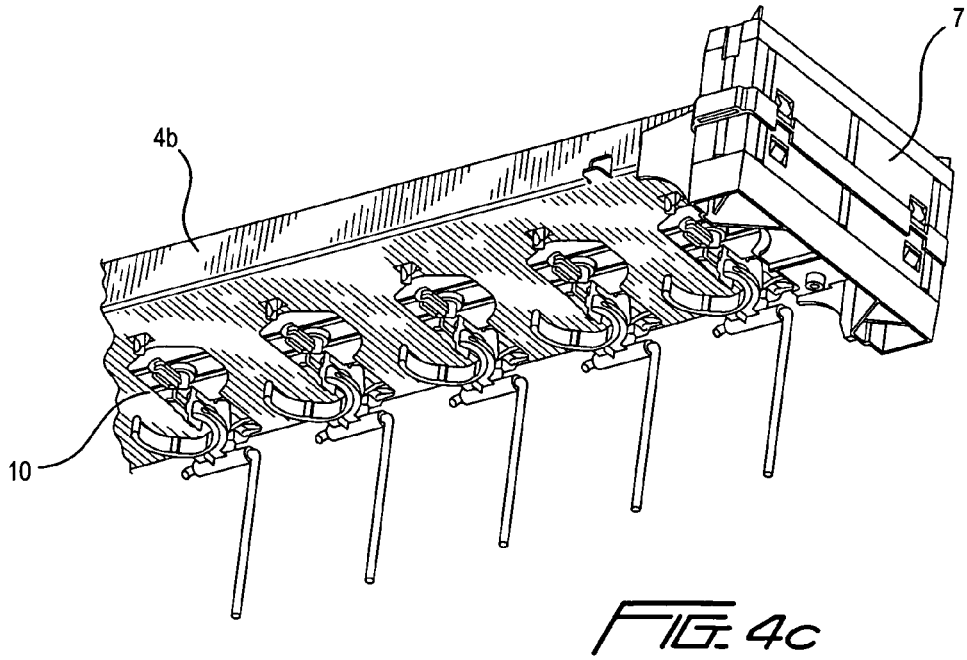
FIGS. 4*b* and 4*c* show details of the mechanical shelf of the modular cabinet in another embodiment of the invention.
Figure 3A:
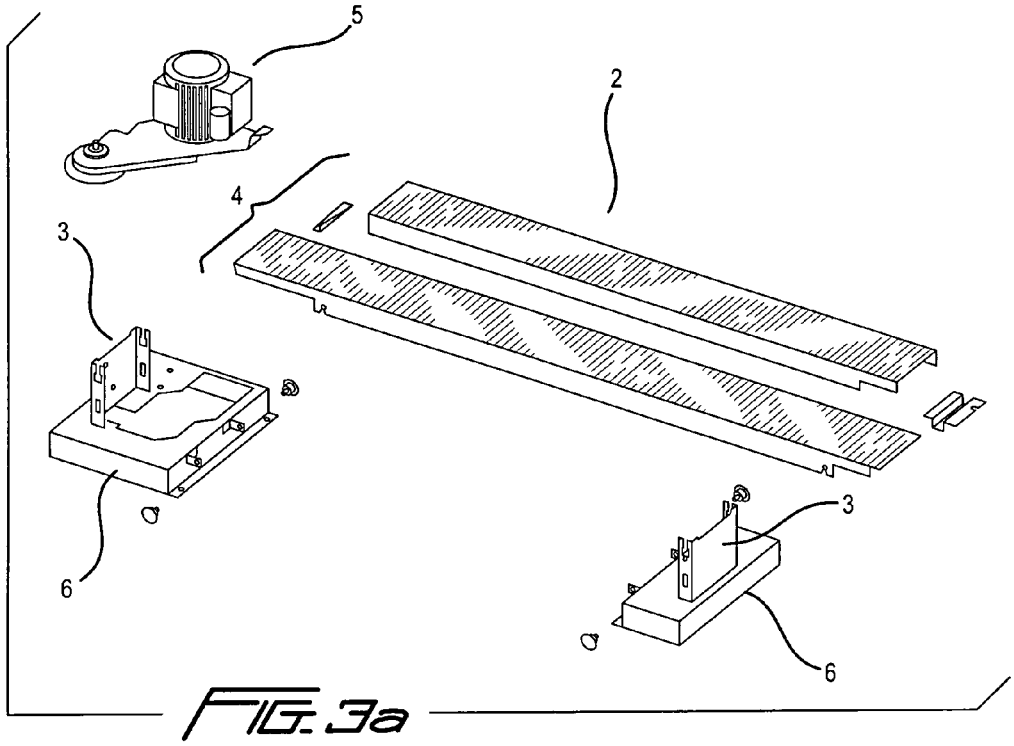
FIGS. 3*a* and 3*b* show the bottom stand of the modular cabinet in an embodiment of the invention.
Figure 3B:
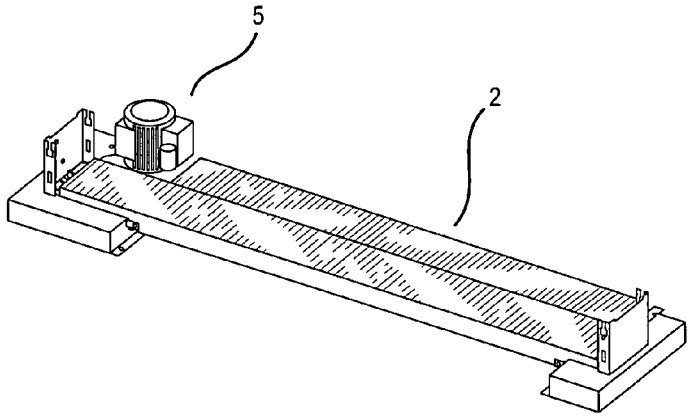
Figure 4A:
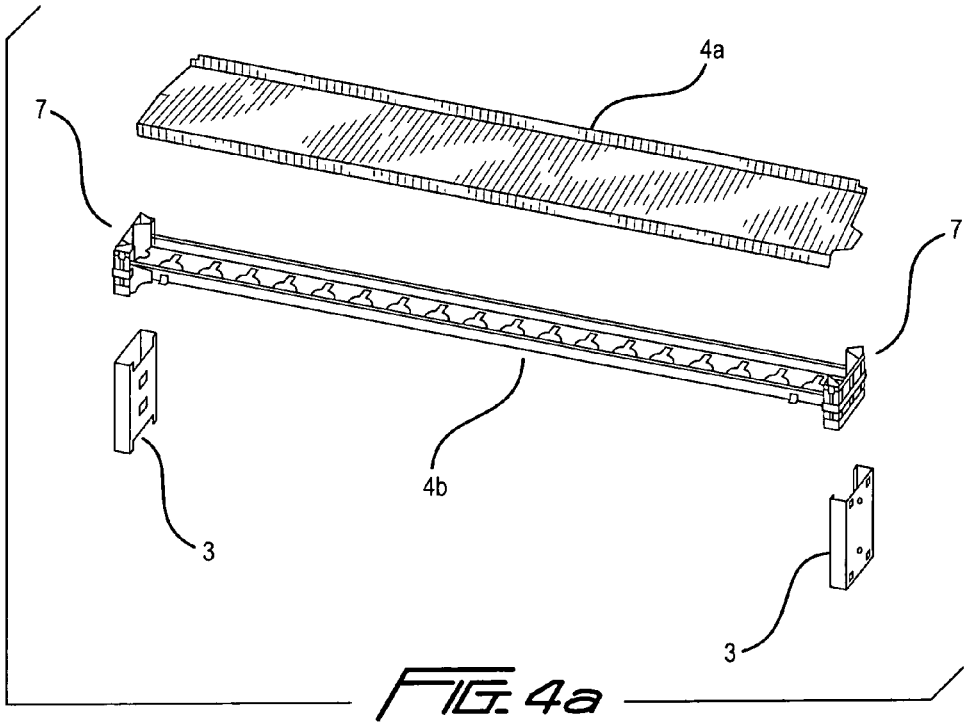
FIG. 4*a* shows a module of the modular cabinet in an embodiment of the invention.

FIG. 4*a* shows a modular cabinet module constituted by two upright elements 3, one on the right the other on the left, and two central node elements 7 together with a mechanical shelf 4 formed by a top portion 4*a* and a bottom portion 4*b*. The top portion 4*a* of the mechanical shelf 4 is constituted by a sheet metal tray for supporting the stirrer cans. The bottom portion 4*b* of the mechanical shelf 4 contains the driven transmission elements of the motion transmission system. In known manner, these motion transmission elements can be constituted by one or more pulleys and a drive belt or a drive chain. By way of example, only one system with blade type drive heads is described below. Nevertheless, and naturally, it would also be possible with the invention to make use of a system having drive lines of the chain or belt type.

Figure 4B:
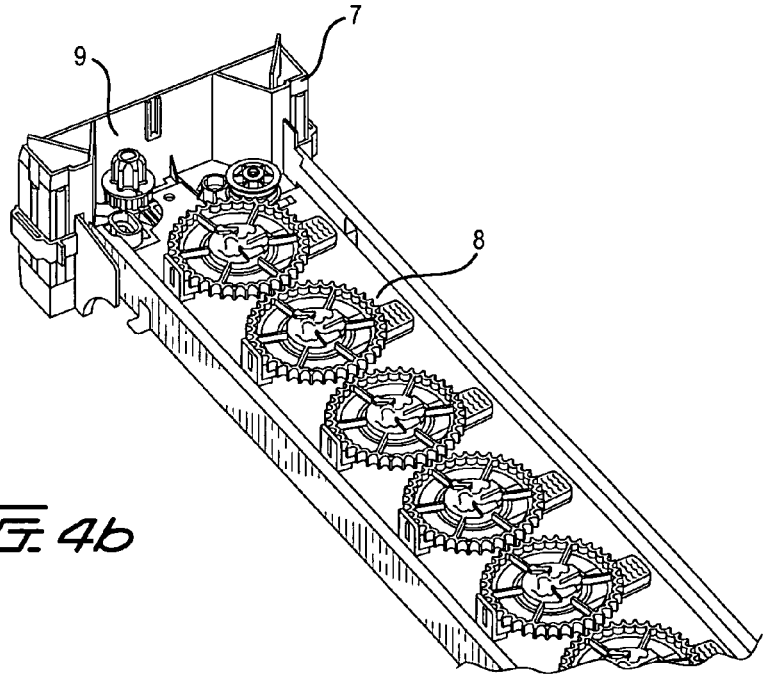

FIGS. 4*b* and 4*c* show details of the mechanical shelf of the modular cabinet in an embodiment of the invention. FIG. 4*b* is a view from above of the bottom portion 4*b* of the mechanical shelf 4, and FIG. 4*c* is a view from below of the bottom portion 4*b* of the mechanical shelf 4. Thus, in FIG. 4*b*, there can be seen the drive system comprising driven transmission elements in the form of pulleys 8 on the bottom portion 4*b* of the mechanical shelf 4. These pulleys 8 are connected to drive blades 10 disposed on the bottom side of the bottom portion 4*b* of the mechanical shelf 4 (see FIG. 4*c*) so as to engage in complementary elements (not shown in FIG. 4*c*) mounted on the stirrer lids of the cans, e.g. projecting fingers. A gear 9 is disposed in the central node 7 where the connection functions between the upright elements 3 and the mechanical shelf 4 are concentrated. The gear 9 is rotated by the motor 5 situated in the bottom stand 2 via a fractioned drive shaft that is described in detail below. Thus, the driver transmission elements of the motion transmission system are disposed outside said mechanical shelf 4 and are independent thereof. The mechanical shelf 4 contains only driven transmission elements. In the embodiment of the invention described, the gear 9 which constitutes a portion of the driver transmission elements of the motion transmission system transmit motion via a cog belt (not shown in. FIG. 4*b*) to the pulleys 8 which constitute the driven transmission elements.

Preferably, the mechanical shelf 4 can be removed without dismantling the stirrer modules. In an advantageous embodiment, the cabinet comprises at least one cabinet module with support shelves for storing cans without any motion transmission element.

Figure 5:
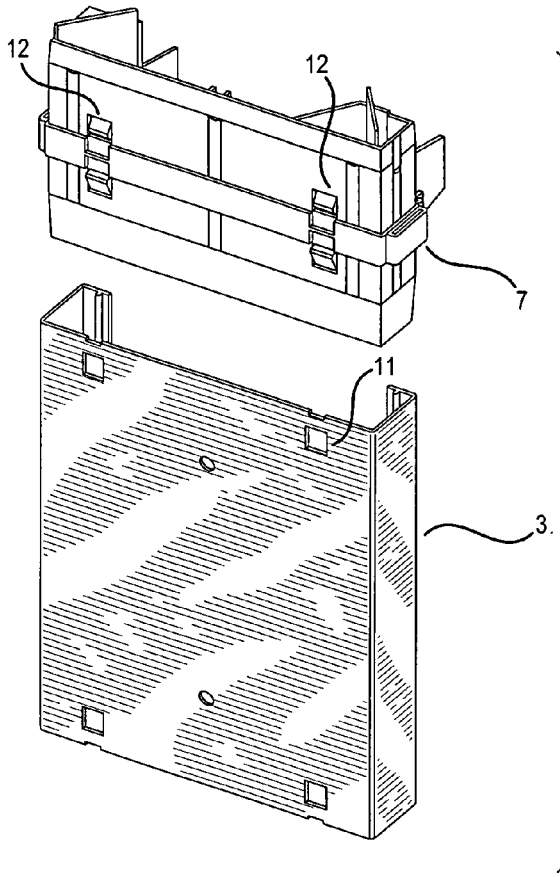
FIG. 5 shows an upright element and a central node of the modular cabinet in an embodiment of the invention.

FIG. 5 shows an upright element 3 and an example of a central connection node 7 of the modular cabinet in an embodiment of the invention. In this example, the central connection node 7 is made as a single piece. The upright element 3 is made in conventional manner out of sheet metal. The central connection node 7 is made of plastics material. It serves amongst other things to interconnect the upright elements 3 and the mechanical shelf 4 so as to stiffen the assembly. The upright elements 3 and the central connection node 7 are assembled together by being engaged one in another and they are held together by a clip assembly. For this purpose, openings or notches 11 are provided in the upright element 3 in which corresponding resilient portions 12 formed on the outside of the central node 7 snap-fasten. The two upright elements and the mechanical shelf of each cabinet module need to be mutually engaged over a distance that is sufficient to ensure that the assembly is rigid.

A central connection is thus provided in two portions capable of ensuring the desired functional versatility. This central connection node 7 or connection is thus the seat of numerous assembly functions. It can be made as a single piece secured to the mechanical shelf 4 and by a left/right symmetry effect it includes the functions of transmitting motion or of guiding motion. The central connection node 7 can be preassembled with the mechanical shelf. During the operation of assembling the cabinet, it then suffices to engage the free portions of the central node 7 in the upright elements 3.

As can be seen in FIGS. 13*a* to 13*d*, the central node can also be made as two symmetrical hermaphrodite portions. It can also be made as a plurality of distinct portions. In FIGS. 13*a* to 13*d* there can be seen an embodiment of a central node made up of two parts made of plastics material. Under such circumstances, one of these parts can be secured to the mechanical shelf and the other can be secured to the upright. The central connection node 7 is built up by snap-fastening together two completely identical plastics material parts that engage one in another over a distance that is sufficient to ensure that the node is rigid.

Figure 6A:
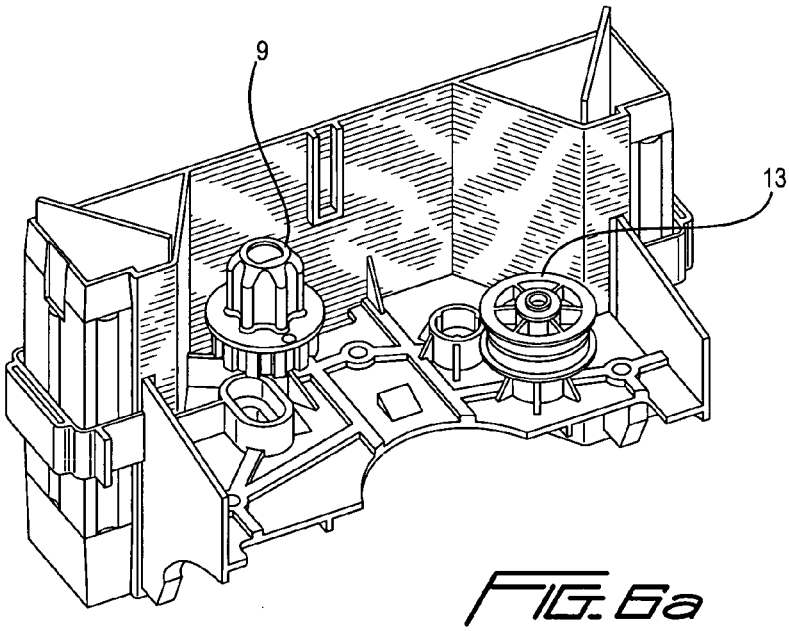
FIGS. 6*a* and 6*b* show the central node of the modular cabinet in an embodiment of the invention in detail together with the left and right side drive elements.
Figure 6B:
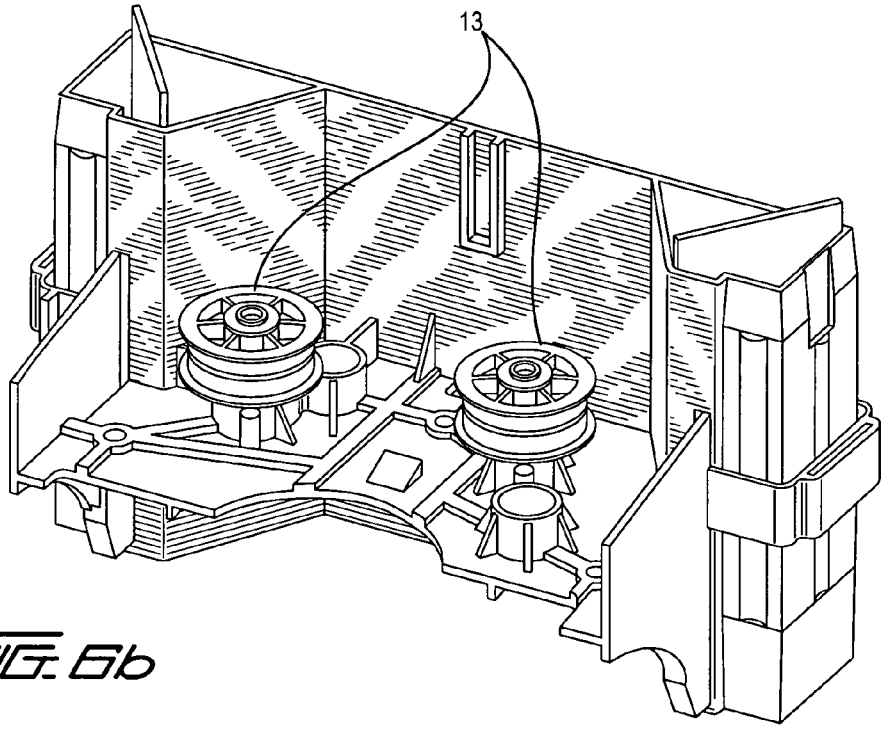

FIGS. 6*a* and 6*b* show the central connection node of the modular cabinet constituting an embodiment of the invention in greater detail. The central node 7 may be configured depending on its position in the modular cabinet, either to include driver transmission elements of the motion transmission system (see FIG. 6*a*), or else by including guide wheels 13 for guiding the belt that forms part of the driven elements (see FIG. 6*b*). The wheels 13 for guiding and tensioning the belt or chain elements can thus also be offset away from the mechanical shelf 4 in order to make construction thereof as simple as possible. Thus, the driver transmission elements or the driven transmission elements can be held or withdrawn without constraint depending on customer configurations or utilization circumstances. Furthermore, the flexibility given to the drive system by the shaft line being located externally makes it possible to envisage changing the indirect drive system into a direct drive system without any visible modification to the stirrer machine. For example, each drive head of the mechanical shelf 4 may have its own individual micromotor. Completely eliminating the traditional motion transmission system can make configuring the stirrer machine more flexible and inexpensive. The principle of a direct drive thus consists in further reducing the number of elements constituting the transmission by bringing the motorization ever closer to the drive heads. Under such circumstances, the shaft line 14, the driver transmission elements and/or the driven transmission elements, and the belt or chain can be omitted in favor of a solution making use of micromotor-driven gearboxes connected directly to the shafts of the drive blades without visibly changing the way in which the can stirrer lids are stored and/or caused to stir. Thus, the motion transmission system may comprise novel driver and driven transmission means completely contained within the mechanical shelf 4.

FIG. 6*a* shows a central node 7 having a drive gear 9 included therein, the function thereof being described above with reference to FIG. 4, together with a belt-guiding wheel 13. Such a configuration for the central node 7 is used on the side where the motor drive is located and at junctions within the shaft line. On the other side of the mechanical shelf 4, there is secured a central node 7 that is identical but that contains two wheels 13 for guiding and tensioning the belt, which wheels are mounted so as to be free to rotate (see FIG. 6*b*).

Figure 7A:
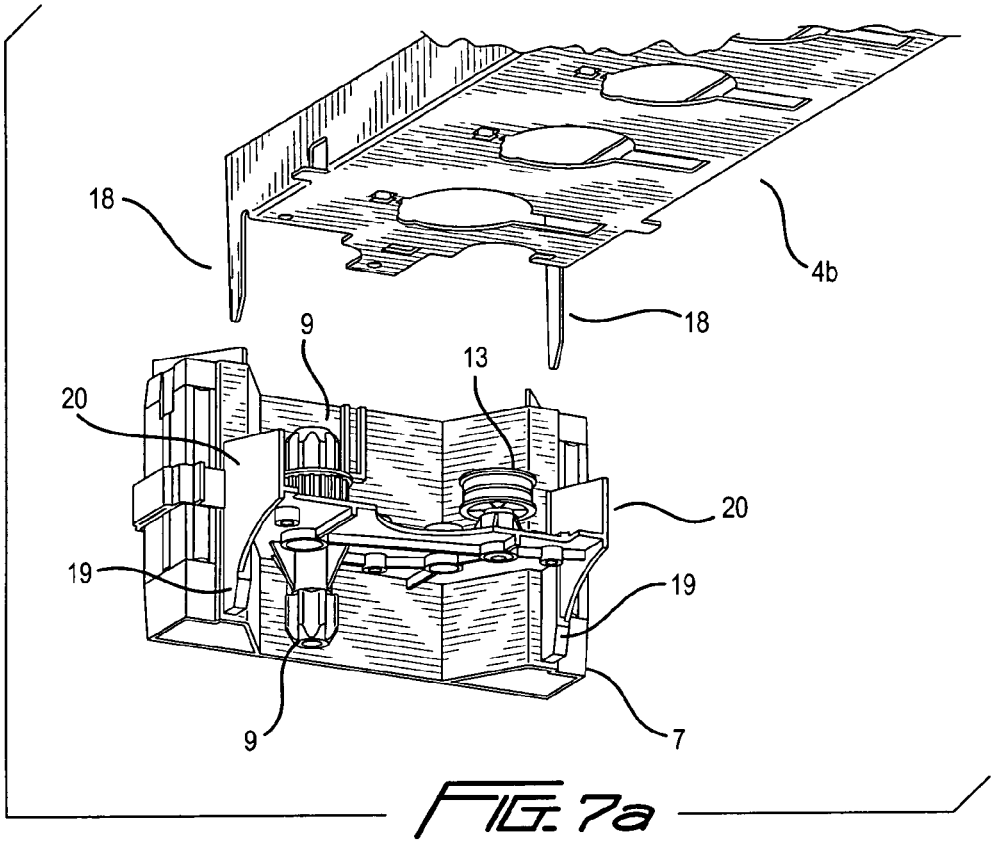
FIGS. 7*a* and 7*b* are respectively a view from beneath and a view from above of a central node of the modular cabinet in an embodiment of the invention, together with the drive elements.

FIG. 7*a* is a view from beneath of a central node 7 of the modular cabinet in a preferred embodiment of the invention. It can be seen that a gear 9 is also to be found on this side of the central node 7. The two gears on either side are interconnected so that rotating one of the gears 9 has the consequence of also driving the other gear.

Figure 7B:
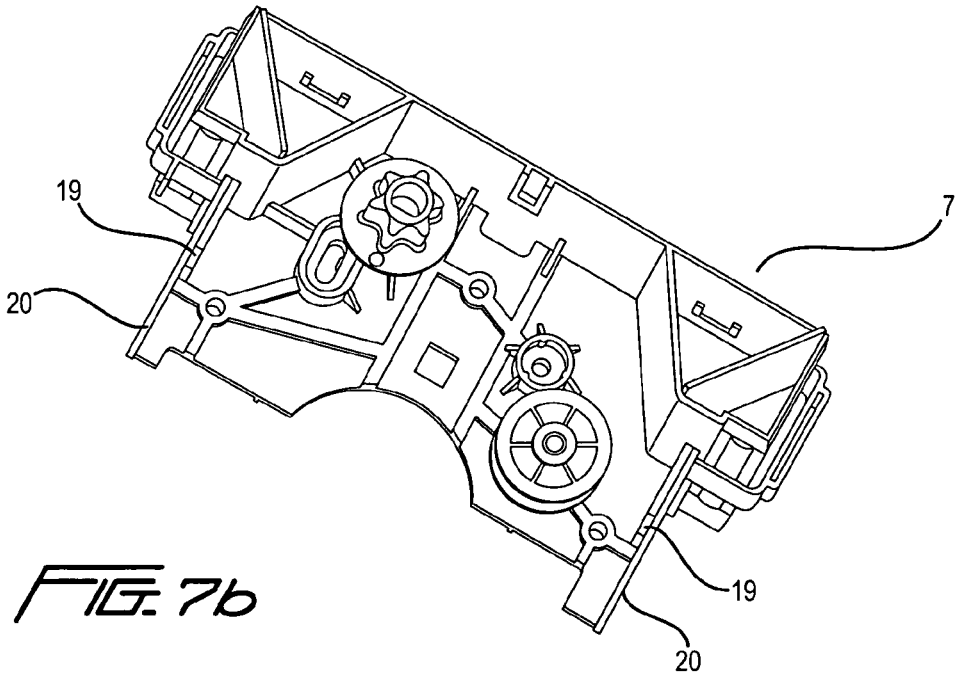

In FIG. 7*a*, there can also be seen the particularly effective and simple engagement means implemented in this embodiment at the ends of the mechanical shelf 4, projecting from its bottom portion 4*b*. During manufacture of the bottom portion 4*b* of the mechanical shelf 4 out of sheet metal, a specific cut is implemented at its ends so that when the sides are folded up to provide a sufficient second moment of area for the mechanical shelf, two long and broad knife-shaped blades 18 appear automatically at the four corners of the sheet metal shelf lying in the same planes as the edges folded at 90° relative to the bottom. The mechanical shelf 4 as formed in this way then behaves like a long beam that is better engaged at the ends for minimizing the transverse amplitude of any swinging movement. Furthermore, the beam with such thick ends bends much less under the effect of a load that is uniformly distributed along its length, as is the case in the present machine, or of a point load in its middle, than would a beam supported on ends that are free to pivot. During assembly, the blades 18 are received in complementary sheaths 19 formed in the central node 7. Guide and stiffening panels are formed on both sides of the central node 7 in this embodiment (see also FIG. 7*b*).

Naturally, such a system for mutually engaging the central node and the support shelf as shown in FIGS. 5 to 7 could be used in other types of cabinet independently of the configuration of the motion transmission system.

Figure 8:
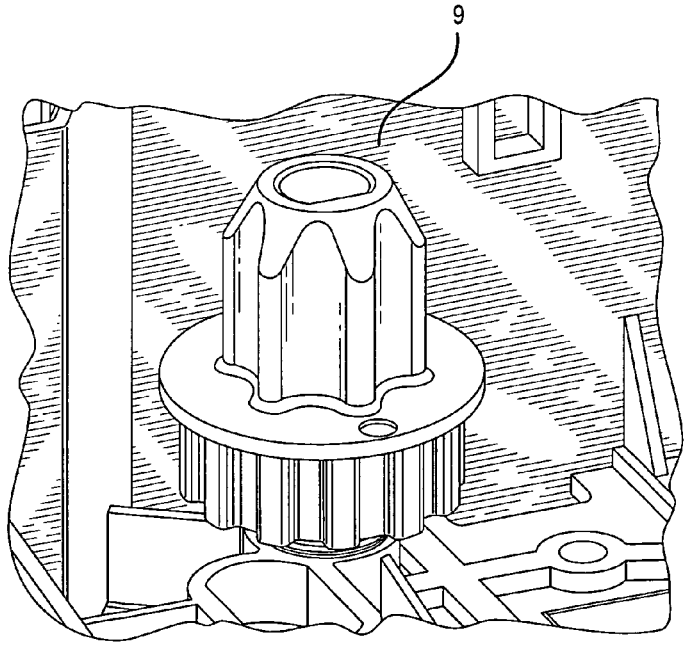
FIG. 8 shows a drive gear of the motion transmission system of an embodiment of the invention.

FIG. 8 shows an example of the drive gear 9 of the motion transmission system in an embodiment of the invention. In this example, the top portion of the drive gear has a Torx® type shape. Nevertheless, it is possible to envisage using a section of any other non-circular curvilinear or polygonal shape, e.g. of triangular or square shape. The bottom portion of the gear 9 is in the form of a conventional gear and serves for driving the cog belt (not shown) that transmits motion to the pulleys 8 (see FIG. 4*b*, for example). In general, only the drive gears 9 on the top side of the central node 7 present such a bottom portion in the form of a conventional gear. Nevertheless, in order to reduce the number of different parts, the drive gears 9 on the bottom side of the central node 7 could likewise include such a portion in the form of a conventional gear. However, under such circumstances, that gear is not used to drive a belt.

Figure 9:
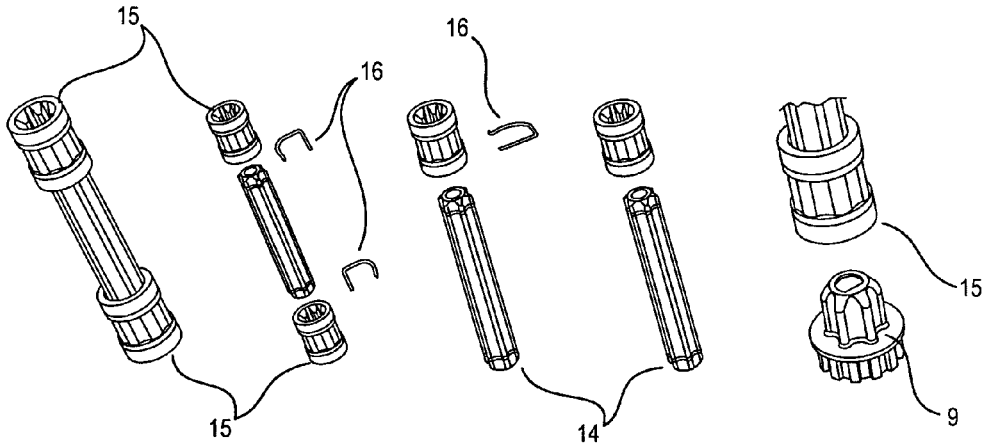
FIG. 9 shows an example of a fractioned drive shaft in an embodiment of the invention.
Figure 2:
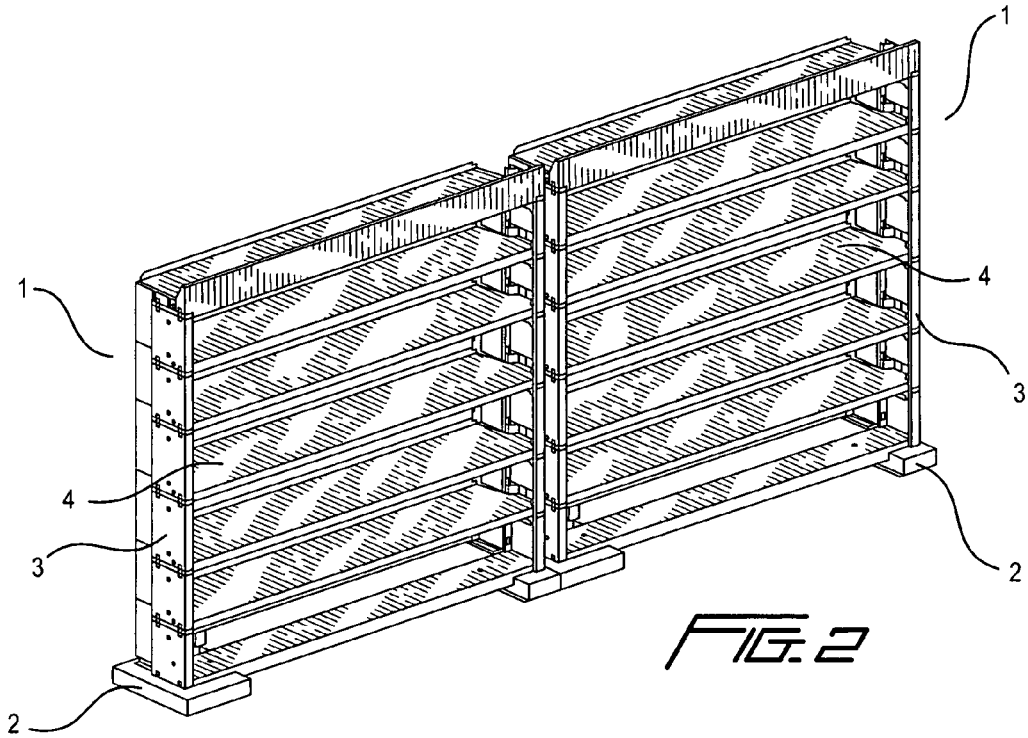
FIG. 2 shows two modular cabinets of the invention disposed side by side.

In an embodiment of the invention, the drive transmission elements are constituted by a line of fractioned drive shafts. FIG. 9 shows an example of such a fractioned drive shaft. The shaft 14 reproduces the configuration of known shafts. The drive shaft has a section of constant non-circular curvilinear or polygonal shape. Preferably, the drive shaft is of a non-circular curvilinear shape of the Torx® type. It could also have a section of constant polygonal shape, e.g. a shape that is triangular or square. It can be made by extrusion. Preferably, the shape of the section of the shaft corresponds to the shape of the section of the drive gear 9. The drive shaft may also possess a hollow core and it may be made of aluminum.

At the two ends of the drive shaft 14, there are secured elements for connecting with the drive gears 9, i.e. endpieces 15 which are internally shaped to receive the external shape of the shaft and of the drive gear 9. These endpieces provide connections between the gears for driving the drive blades at each node. The endpieces 15 are engaged on the drive shaft 14 and the drive gear 9 with sufficient clearance to allow for simple and fast angular self-adjustment of the line of shafts while assembling the two ends of the integrated upright and fractioned shaft assembly on a lower shelf that is already in place, and subsequently while assembling an upper shelf on the upright that is already in place. It is thus possible to ensure that a flexible connection is provided for accommodating departures from alignment in a modular structure. The mechanical energy required during angular acceleration on starting is optimized by reducing the moments of inertia of the line of shafts. Furthermore, the endpieces are preferably made of a plastics material that is sufficiently elastic to accommodate shocks on starting and sufficiently hard to be capable of transmitting torque.

The endpieces of the shafts are fitted and held in place by U-shaped clips 16. The number of parts in the shaft line is thus is extremely small and it has a high degree of accessibility in the event of it being disassembled for the purpose of changing a belt.

Figure 10:
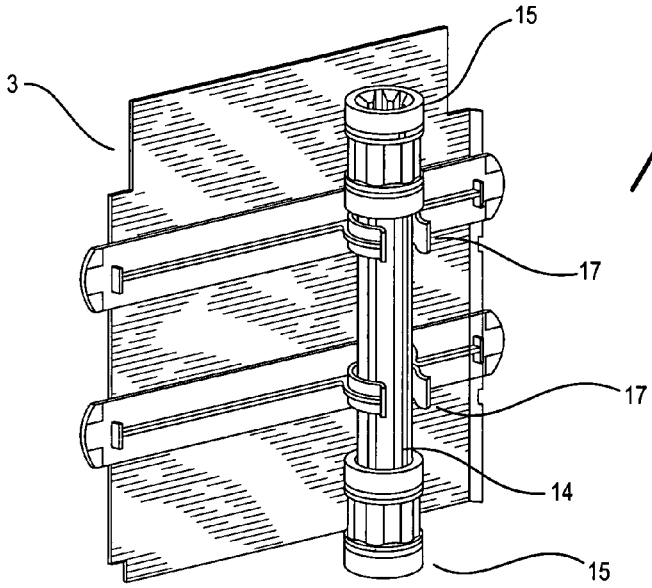
FIG. 10 shows an example of how the fractioned drive shaft is secured in an embodiment of the invention.

One of the two upright elements 3 in each module carries a portion of the fractioned drive shaft. FIG. 10 shows an example of how the fractioned drive shaft is fastened against the upright element 3. The portion of the fractioned drive shaft 14 is secured to the upright element 3 in such a manner as to leave it free to move in rotation and in translation. The connection is preferably releasable and provided by the shaft being held in clips 17. This achieves a significant reduction in the number of component parts making up the line of shafts and provides great accessibility for dismantling the shaft.

Naturally, such a fractioned drive shaft system and system for securing the shaft against the upright element as shown in FIGS. 9 and 10 could be used with other types of cabinet independently of the configuration of the motion transmission system.

Figure 1:
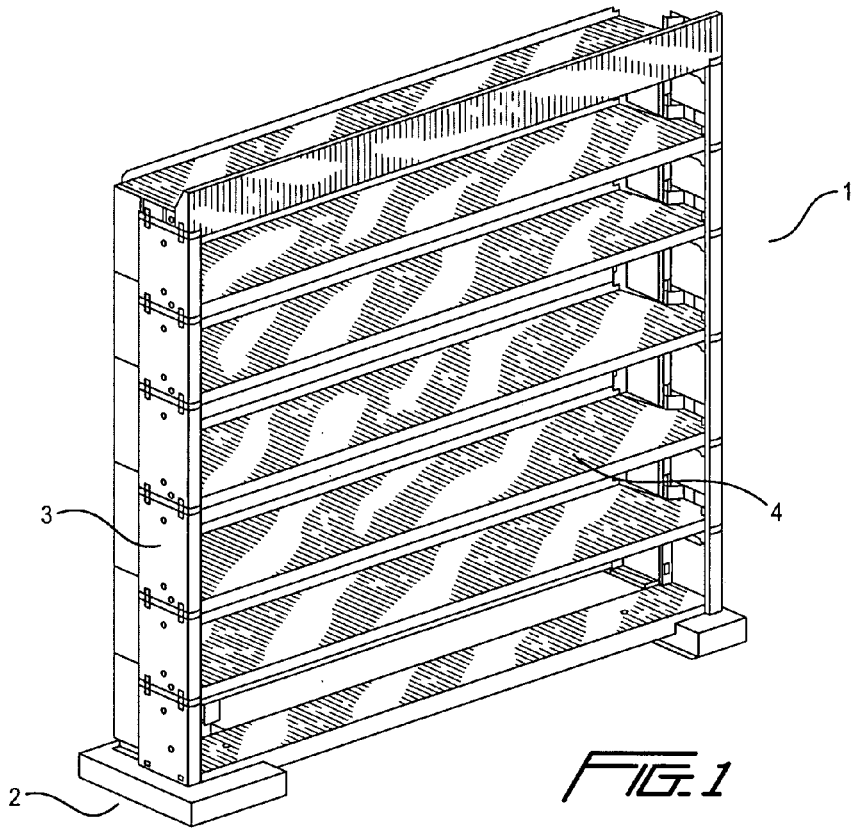
FIG. 1 is a general view of a modular cabinet constituting an embodiment of the invention.
Figure 11:
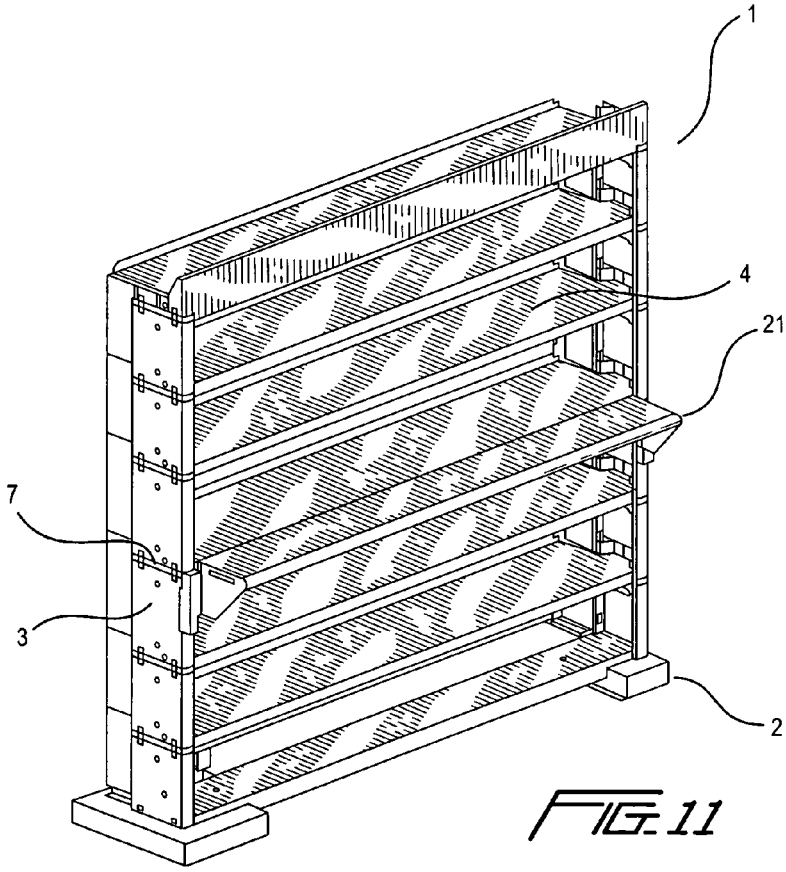
FIG. 11 shows a modular cabinet in an embodiment of the invention with an accessory work surface.
Figure 12:
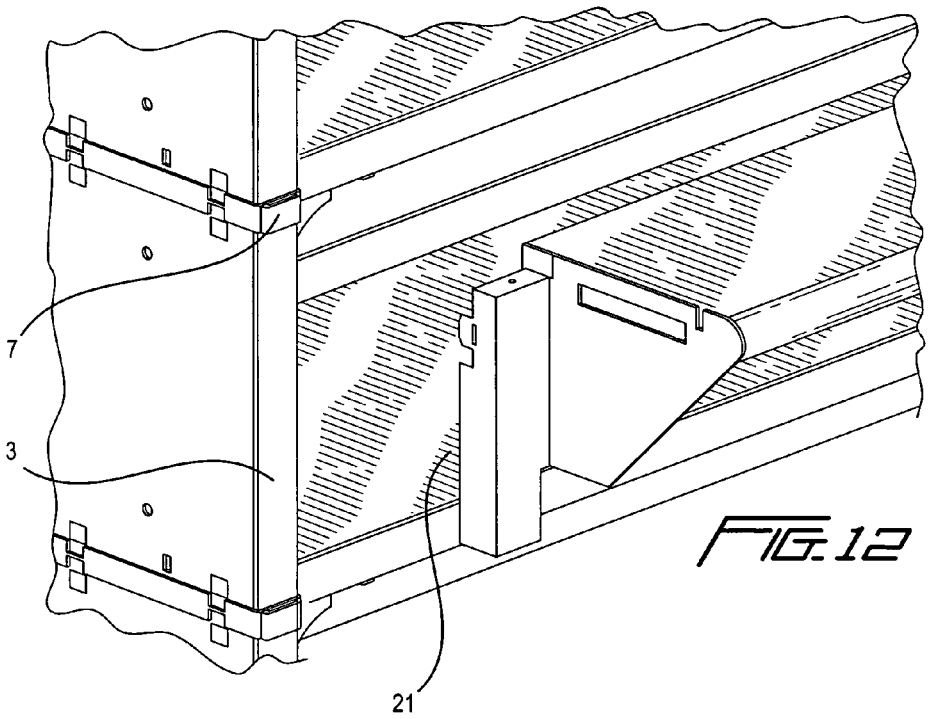
FIG. 12 shows a detail of FIG. 11.
Figure 13A:
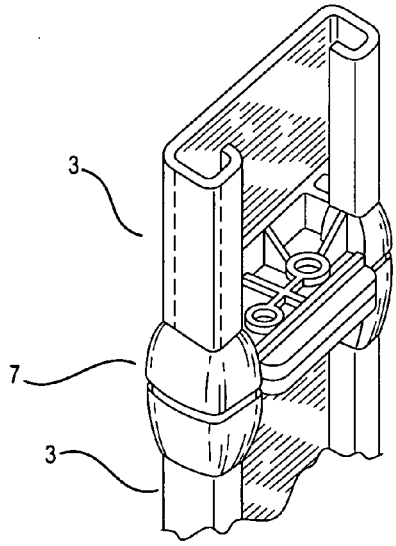
FIGS. 13*a* to 13*d* show an embodiment of a central node reconstituted using two parts made of plastics material.
Figure 13B:
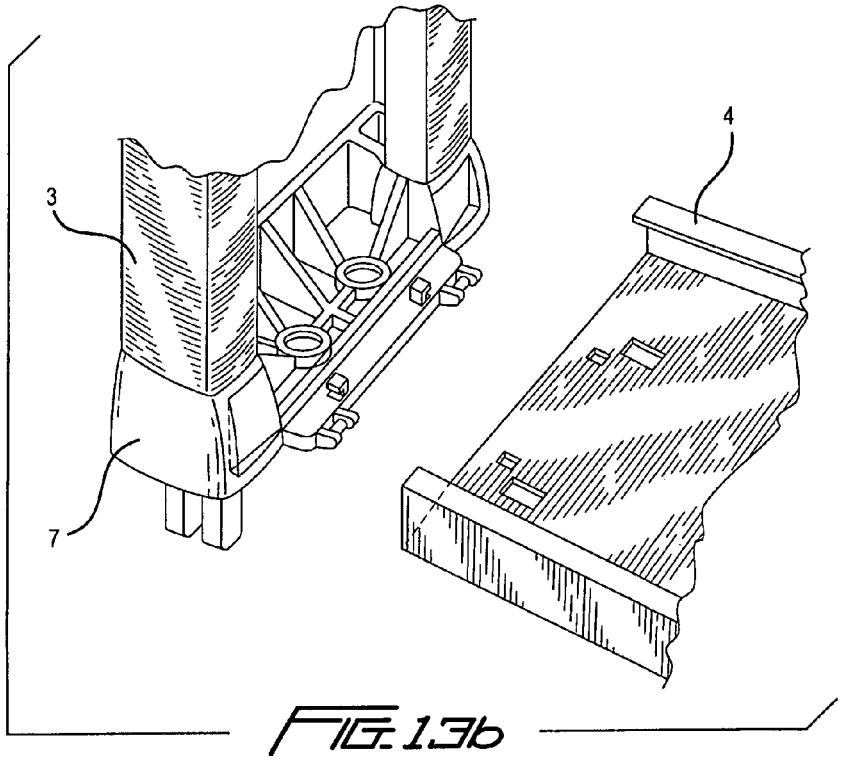
Figure 13C:
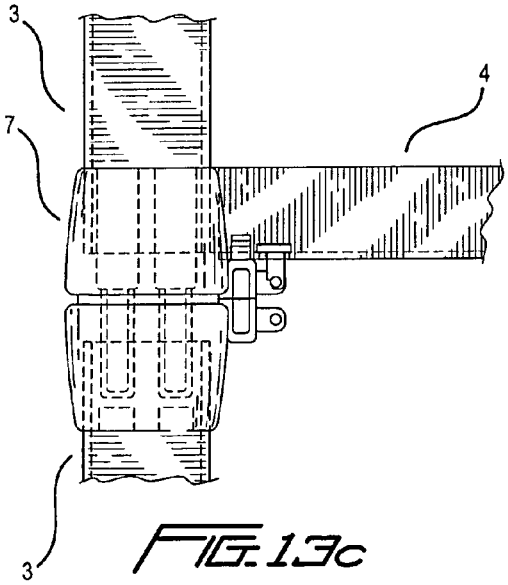
Figure 13D:
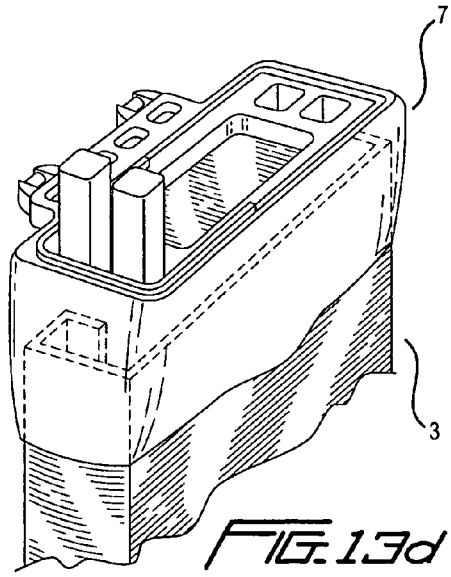

FIG. 11 shows a modular cabinet 1, shown in FIG. 1, in an embodiment of the invention that further includes an accessory work surface 21, and FIG. 12 shows a detail of the accessory work surface 21 in FIG. 11. The central node 7, besides serving as a seat for the accessory work surface (21) as shown in FIGS. 11 and 12, may also serve as a seat for fastening a multitude of accessory elements such as an electronic control unit, coverings, rear storage shelves, etc.

FIGS. 13*a* to 13*d* show an embodiment of a central node 7 made up from two plastics parts that are totally identical.

The invention claimed is:

1. A modular cabinet for storing and driving stirrer cans containing liquids, the modular cabinet (1) comprising a bottom stand (2) on which at least one cabinet module is mounted, and a motion transmission system constituted by driver transmission elements (9, 14) and driven transmission elements (8), each cabinet module being made up of two upright elements (3) and a mechanical shelf (4) for supporting and driving stirrer cans, the modular cabinet being characterized in that the driver transmission elements (9, 14) of the motion transmission system are disposed outside said mechanical shelf (4) and are independent thereof, and in that the mechanical shelf (4) contains only driven transmission elements (8), the connection functions between the upright elements and the mechanical shelf are concentrated in a central connection node (7) within the upright elements (3) serving to provide the assembly with rigidity, and the driver transmission elements are constituted by a line of fractioned drive shafts (14).

2. A modular cabinet according to claim 1, characterized in that the upright elements (3) and the central connection node (7) are assembled together by being engaged one within another and are held together by snap-fastening.

3. A modular cabinet according to claim 1, characterized in that the central connection node (7) is made of two symmetrical hermaphrodite portions.

4. A modular cabinet according to claim 1, characterized in that the central connection node (7) constitutes a seat for fastening accessory elements.

5. A modular cabinet according to claim 1, characterized in that the central connection node (7) is made of plastics material.

6. A modular cabinet according to claim 1, characterized in that the two upright elements (3) and the mechanical shelf (4) of each cabinet module are mounted by mutual engagement over a distance that is sufficient to ensure that the assembly is rigid.

7. A modular cabinet according to claim 6, characterized in that one of the two upright elements (3) of each module comprises a fractioned drive shaft portion (14) and in that said fractioned drive shaft portion (14) is secured to the upright elements (3) in such a manner as to be free to move in rotation and in translation.

8. A modular cabinet according to claim 7, characterized in that said fractioned drive shaft portion (14) is secured to the upright elements (3) in removable manner.

9. A modular cabinet according to claim 6, characterized in that the drive shaft (14) presents a section of constant non-circular curvilinear or polygonal shape.

10. A modular cabinet according to claim 9, characterized in that the drive shaft (14) presents a non-circular curvilinear shape of Torx® type.

11. A modular cabinet according to claim 6, characterized in that endpieces (15) are secured to both ends of the drive shaft (14), the endpieces matching the geometrical shapes of the shaft and providing connections to the gears (9) driving the drive blades at each central connection node (7).

12. A modular cabinet according to claim 11, characterized in that the endpieces (15) are engaged on the drive gears (9) of each central connection node (7) with clearance that is sufficient to enable the line of shaft to self-adjust angularly in simple and rapid manner during assembly.

13. A modular cabinet according to claim 11, characterized in that the endpieces are made of a plastics material that is sufficiently elastic to accommodate shocks on starting and sufficiently hard to transmit torque.

14. A modular cabinet according to claim 11, characterized in that the endpieces (15) are fitted and secured by U-shaped clips.

15. A modular cabinet according to claim 6, characterized in that the drive shaft (14) is made by extrusion.

16. A modular cabinet according to claim 6, characterized in that the drive shaft (14) possesses a hollow core.

17. A modular cabinet according to claim 6, characterized in that the drive shaft (14) is made of aluminum.

18. A modular cabinet according to claim 1, characterized in that the bottom stand (2) includes a motor for driving drive transmission elements.

19. A modular cabinet according to claim 18, characterized in that the motor (5) can be removed without disassembling either the bottom stand (2) or the structure of the machine.

20. A modular cabinet according to claim 1, characterized in that the mechanical shelf (4) is removable without dismantling the stirrer modules.

21. A modular cabinet according to claim 1, characterized in that the cabinet includes at least one cabinet module with support shelves for storing cans without motion transmission elements.

* * * * *